US009661910B2

(12) United States Patent
Liu

(10) Patent No.: US 9,661,910 B2
(45) Date of Patent: May 30, 2017

(54) EYE LINER PENCIL HAVING A SINGLE APPLICATOR

(71) Applicant: Li-Mei Liu, New Taipei (TW)

(72) Inventor: Li-Mei Liu, New Taipei (TW)

(73) Assignee: CHUEN CHURN CO., LTD, New Taipei (TW)

( * ) Notice: Subject to any disclaimer, the term of this patent is extended or adjusted under 35 U.S.C. 154(b) by 0 days.

(21) Appl. No.: 15/004,465

(22) Filed: Jan. 22, 2016

(65) Prior Publication Data

US 2016/0374454 A1 Dec. 29, 2016

(30) Foreign Application Priority Data

Jun. 23, 2015 (TW) ..... 104209983 U

(51) Int. Cl.
*B43K 8/06* (2006.01)
*A45D 34/04* (2006.01)
*A45D 34/00* (2006.01)

(52) U.S. Cl.
CPC ..... *A45D 34/042* (2013.01); *A45D 2034/007* (2013.01); *A45D 2200/1072* (2013.01)

(58) Field of Classification Search
CPC ..... A45D 34/042; A45D 2200/1072; B43K 8/026; B43K 8/06
USPC ..... 401/198
See application file for complete search history.

(56) References Cited

U.S. PATENT DOCUMENTS

| | | | | |
|---|---|---|---|---|
| 8,449,213 | B2 * | 5/2013 | Chang | A45D 34/04 401/199 |
| 9,314,087 | B2 * | 4/2016 | Ishida | A45D 40/26 |
| 9,554,635 | B1 * | 1/2017 | Liu | A45D 34/04 |
| 2009/0010702 | A1 * | 1/2009 | Nehashi | A45D 34/042 401/24 |
| 2012/0266907 | A1 * | 10/2012 | Chan | A45D 34/042 132/218 |

* cited by examiner

*Primary Examiner* — Jennifer C Chiang

(57) ABSTRACT

An eye liner pencil includes a cap including an internal annular ridge; a hollow member in the cap; a tubular handle including a front first opening, an annular protrusion rearward of the first opening and configured to secure to the ridge, a rear second opening, and an internal annular trough adjacent to the second opening; a hollow support including a tapered rear end, a front opening, an internal space, an externally threaded section, and protuberances; a felt wick including an applicator; a sleeve including parallel surface slit, and a rear internally threaded section secured to the externally threaded section; a hollow, cylindrical sponge member with the support inserted through to secure the sponge member onto the support; a cylindrical reservoir with the support inserted into; and a hollow plug member including a rear external rim d wherein the trough is secured to the rim.

9 Claims, 6 Drawing Sheets

EYE LINER PENCIL HAVING A SINGLE APPLICATOR

BACKGROUND OF THE INVENTION

1. Field of the Invention

The invention relates to eye liner pencils and more particularly to an eye liner pencil having a single applicator with liquid absorbing and vapor expelling arrangement and being environment-friendly.

2. Description of Related Art

There are many types of eye liner pencil available on the market. A conventional eye liner pencil comprises a container for storing a liquid source, an applicator at a tip, and a felt wick for conveying the liquid to the applicator.

However, conventional eye liner pencils have the following drawbacks. Its construction is complicated. It contains non environment-friendly metal components. Liquid may leak out of the container due to low quality or inadvertent falling. Finally, it is not environment-friendly.

Thus, the need for improvement still exists.

SUMMARY OF THE INVENTION

It is therefore one object of the invention to provide an eye liner pencil comprising a hollow, cylindrical cap including a rear opening and an internal annular ridge adjacent to the rear opening; a stepped-diameter hollow member disposed in the cap and including an external annular projection releasably fastened in the cap; a hollow, tubular handle including a first opening at a front end, an annular protrusion of decreased diameter disposed rearward of the first opening and configured to secure to the ridge, a second opening at a rear end, and an internal annular trough adjacent to the second opening; a hollow, elongated support including a tapered rear end, a front opening, an internal space, an externally threaded section proximate the front opening, an annular inclined surface disposed between the front opening and the externally threaded section, and a plurality of equally spaced protuberances disposed rearward of the externally threaded section and secured to an internal surface of the protrusion; a felt wick having a rear end engaged a bottom of the internal space, the felt wick including an applicator at a front tip; a sleeve including a front opening, a plurality of parallel slits on a surface, and an internally threaded section on a rear portion and threadedly secured to the externally threaded section wherein both the felt wick and the sleeve are inserted through the second opening with the slits fastened by an internal surface of a front portion of the handle, and the applicator is exposed; a cylindrical sponge member including an axial channel wherein the rear end of the support is inserted through the channel to secure the sponge member onto the support; a cylindrical reservoir having an outer diameter less than an inner diameter of the handle and including a front opening for allowing the rear end of the support to insert into and to be fastened therein wherein the internal space is partially disposed in the front opening of the reservoir; and a hollow plug member including an external rim adjacent to a rear enlarged end wherein the trough is complimentarily engaged with the rim to secure the plug member and the handle together.

The above and other objects, features and advantages of the invention will become apparent from the following detailed description taken with the accompanying drawings.

DETAILED DESCRIPTION OF THE INVENTION

Figure 1:
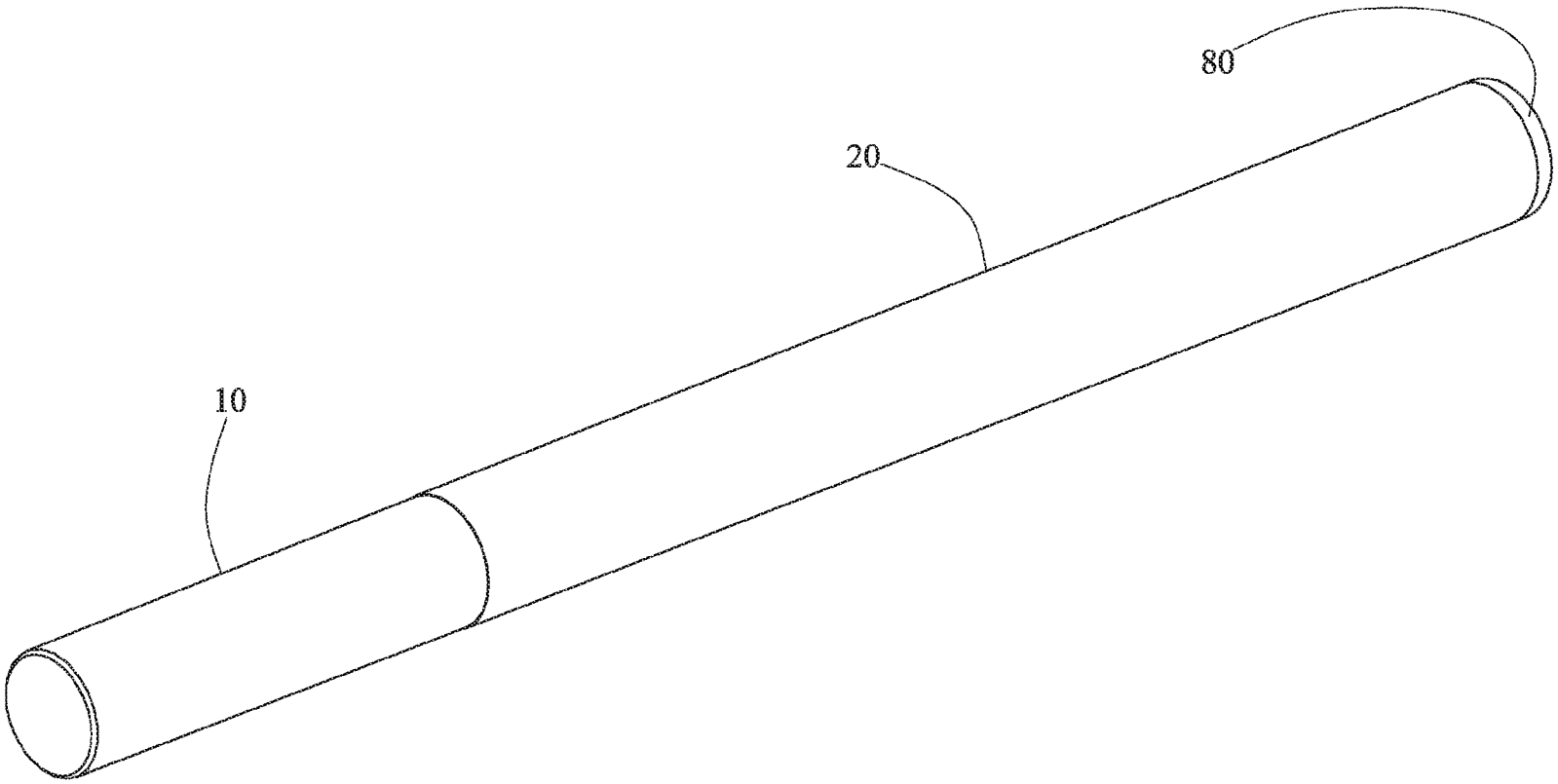
FIG. 1 is a perspective view of an eye liner pencil according to a first preferred embodiment of the invention.
Figures 2, 2A:
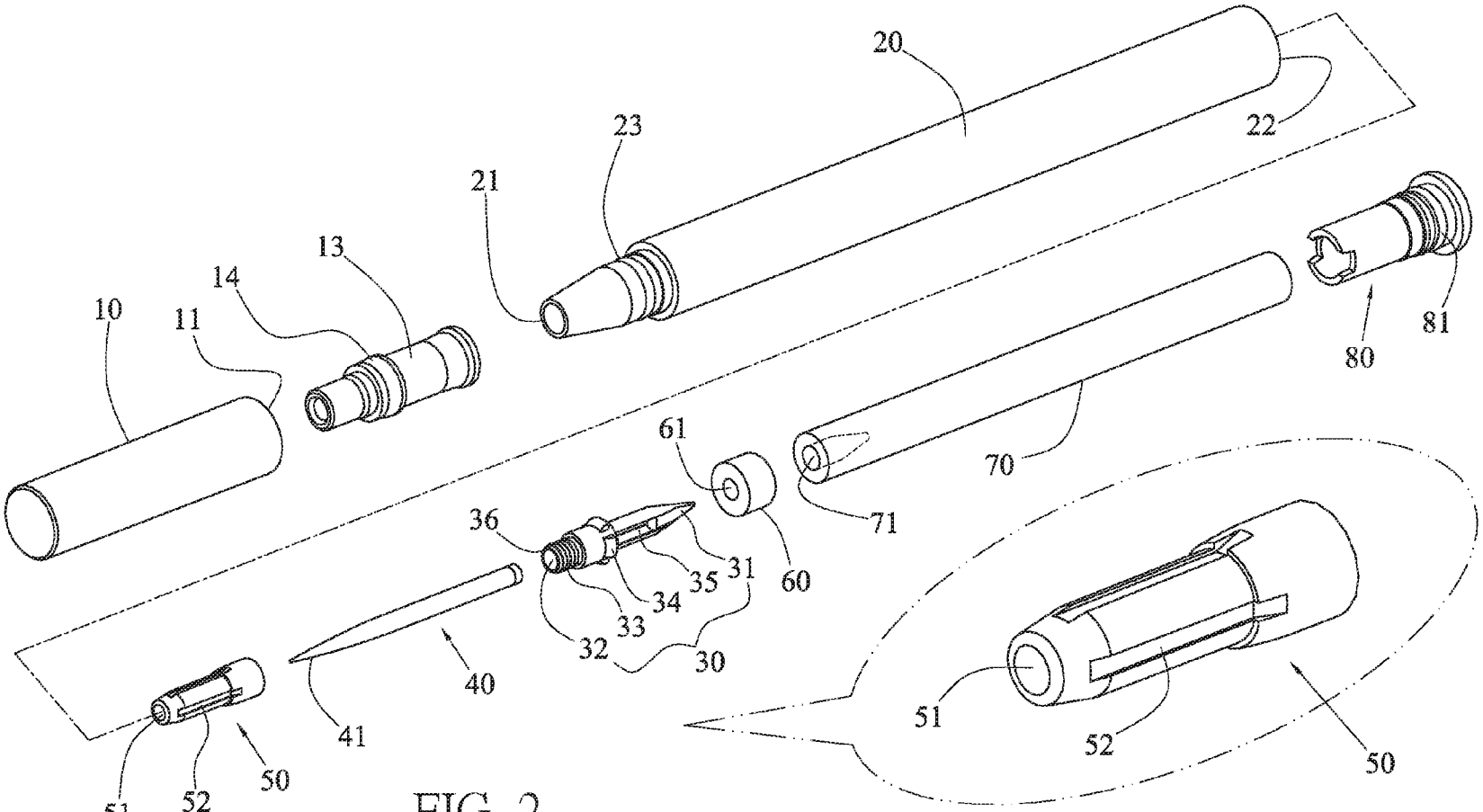
FIG. 2 is an exploded view of the eye liner pencil.
FIG. 2A is a detailed view of the sleeve.
Figure 3:
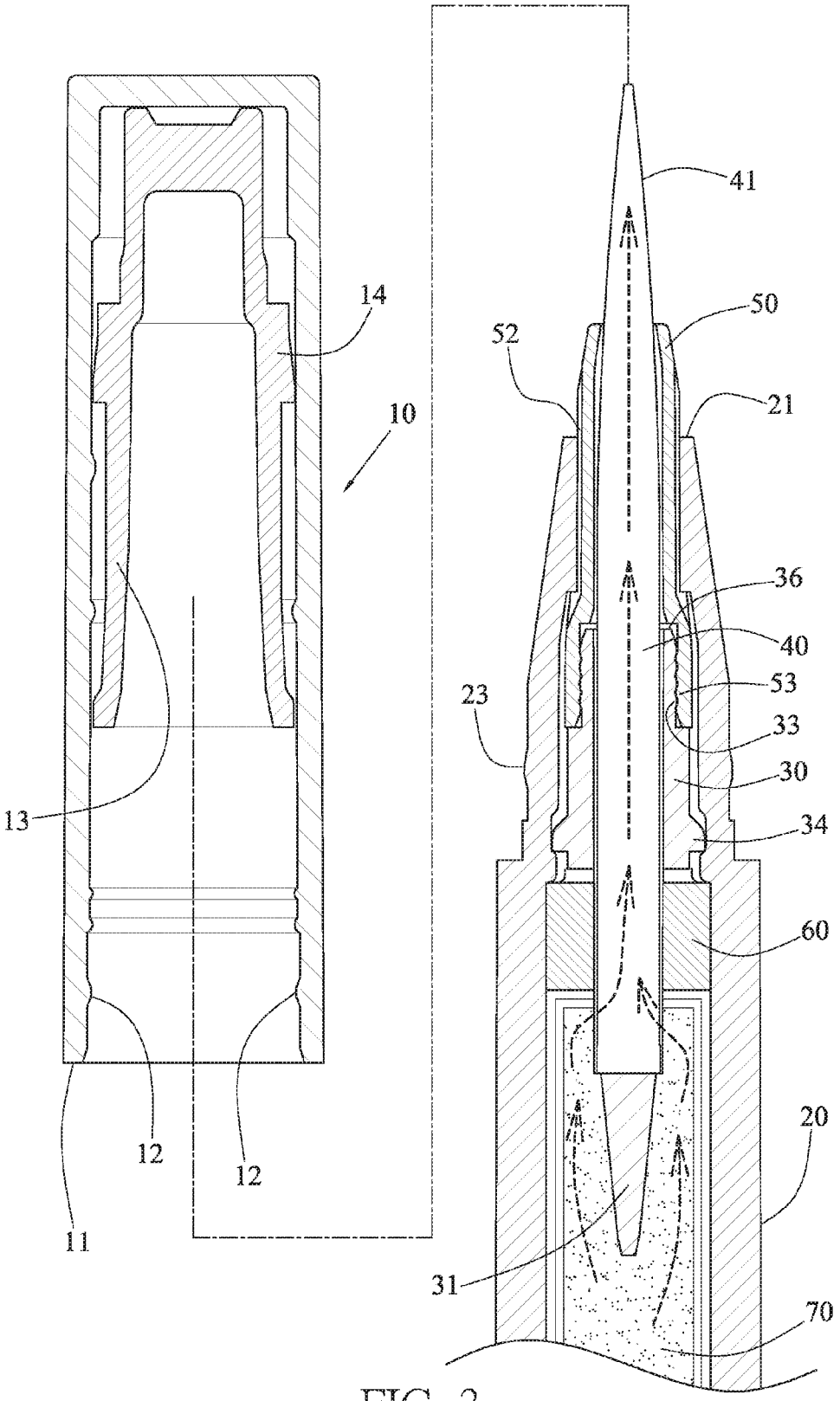
FIG. 3 is a longitudinal sectional view of the marking portion of the eye liner pencil with the cap separated and showing liquid flow.
Figure 4:
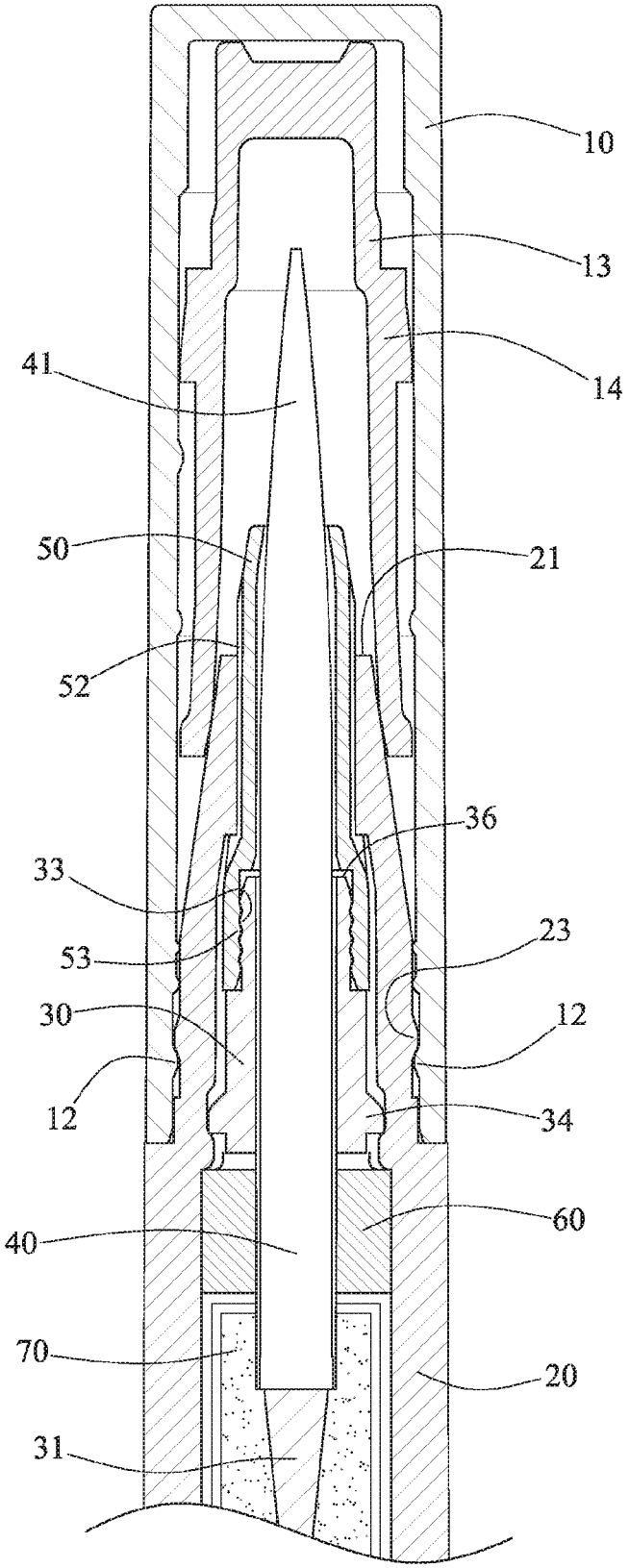
FIG. 4 is a longitudinal sectional view of the marking portion of the eye liner pencil with the cap put on and liquid flow being stopped.
Figure 5:
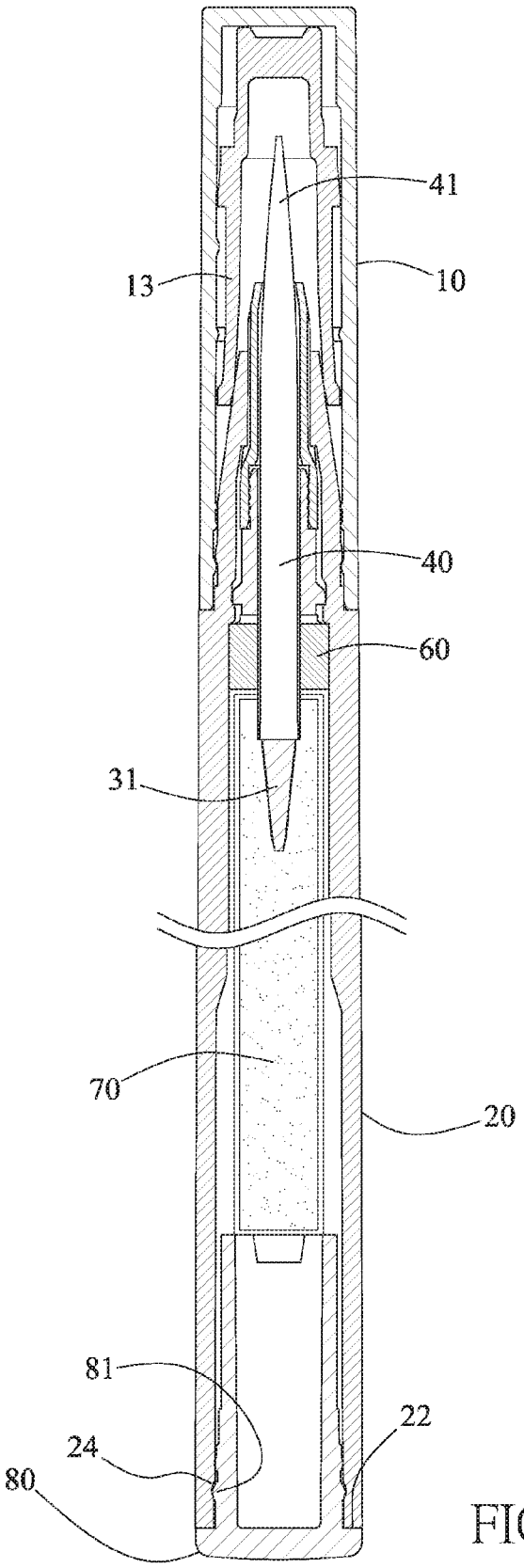
FIG. 5 is a longitudinal sectional view of the eye liner pencil.

Referring to FIGS. 1 to 5, an eye liner pencil in accordance with a first preferred embodiment of the invention comprises the following components as discussed in detail below.

A hollow, cylindrical cap 10 includes a rear opening 11 and an internal annular ridge 12 adjacent to the rear opening 11. A stepped-diameter hollow member 13 in the cap 10 and includes an external annular projection 14 releasably fastened in the cap 10. A hollow, tubular handle 20 includes a front opening 21, an annular protrusion 23 of decreased diameter disposed rearward of the front opening 21 and configured to secure to the ridge 12, a rear opening 22, and an internal annular trough 24 adjacent to the rear opening 22. A hollow, elongated support 30 includes a tapered rear end 31, a front opening 32, an internal space 35, an externally threaded section 33 proximate the front opening 32, an annular inclined surface 36 disposed between the front opening 32 and the externally threaded section 33, and a plurality of equally spaced protuberances 34 rearward of the externally threaded section 33 and secured to an internal surface of the protrusion 23.

A felt wick 40 has a rear end engaged a bottom of the space 35 after inserting through the opening 32. The felt wick 40 includes an applicator 41 at a front tip. A sleeve 50 includes a front opening 51, a plurality of parallel slits 52 on a surface, and an internally threaded section 53 on a rear portion and configured to threadedly secure to the externally threaded section 33. The felt wick 40 is inserted through the sleeve 50 until being stopped and fastened with the applicator 41 exposed at the opening 51. Both the felt wick 40 and the sleeve 50 are inserted through the rear opening 22 until being stopped with the slits 52 fastened by an internal surface of a front portion of the handle 20 and the applicator 41 exposed at the opening 21. A cylindrical sponge member 60 includes an axial channel 61. The rear end 31 of the support 30 is inserted through the channel 61 until the sponge member 60 is secured onto a portion of the support 30 between the protuberances 34 and the rear end 31. A cylindrical reservoir 70 has an outer diameter slightly less than an inner diameter of the handle 20 and includes a front opening 71 for allowing the rear end 31 of the support 30 to insert into and to be fastened therein. Also, the space 35 is partially disposed in the opening 71. A hollow plug member 80 includes an external rim 81 adjacent to a rear enlarged end. The trough 24 is complimentarily engaged with the rim 81 to secure the plug member 80 and the handle 20 together.

A section between the opening 21 and the trough 24 is tapered toward the opening 21.

The front opening 51 has a circular, oval, or polygonal mouth.

The applicator 41 is an integral part of the felt wick 40.

The applicator 41 is made of brush, tipped nylon, inclined nylon, or latex.

The mouth of the opening 51 is shaped to allow the applicator 41 to pass through and be stopped when the applicator 41 contacts the mouth of the opening 51.

The cap 10, the hollow member 13, the support 30, the sleeve 50, and the plug member 80 are made of an environment-friendly plastic.

The slits 52 are elongated and disposed rearward of the opening 51.

How to apply eye liner color around the contours of the eye is described as follows:

First, the cap 10 is removed to expose the applicator 41. Liquid stored in the reservoir 70 flows to the applicator 41 through the felt wick 40 due to capillary action. Finally, a person may apply the liquid around the contours of the eye by using the applicator 41.

After the application. the person may place the cap 10 onto the front end of the handle 20 by putting the opening 11 onto the opening 21 until the trough 24 and the ridge 12 are secured together. Thereafter, the person may carry the eye liner pencil or store same.

Figure 6:
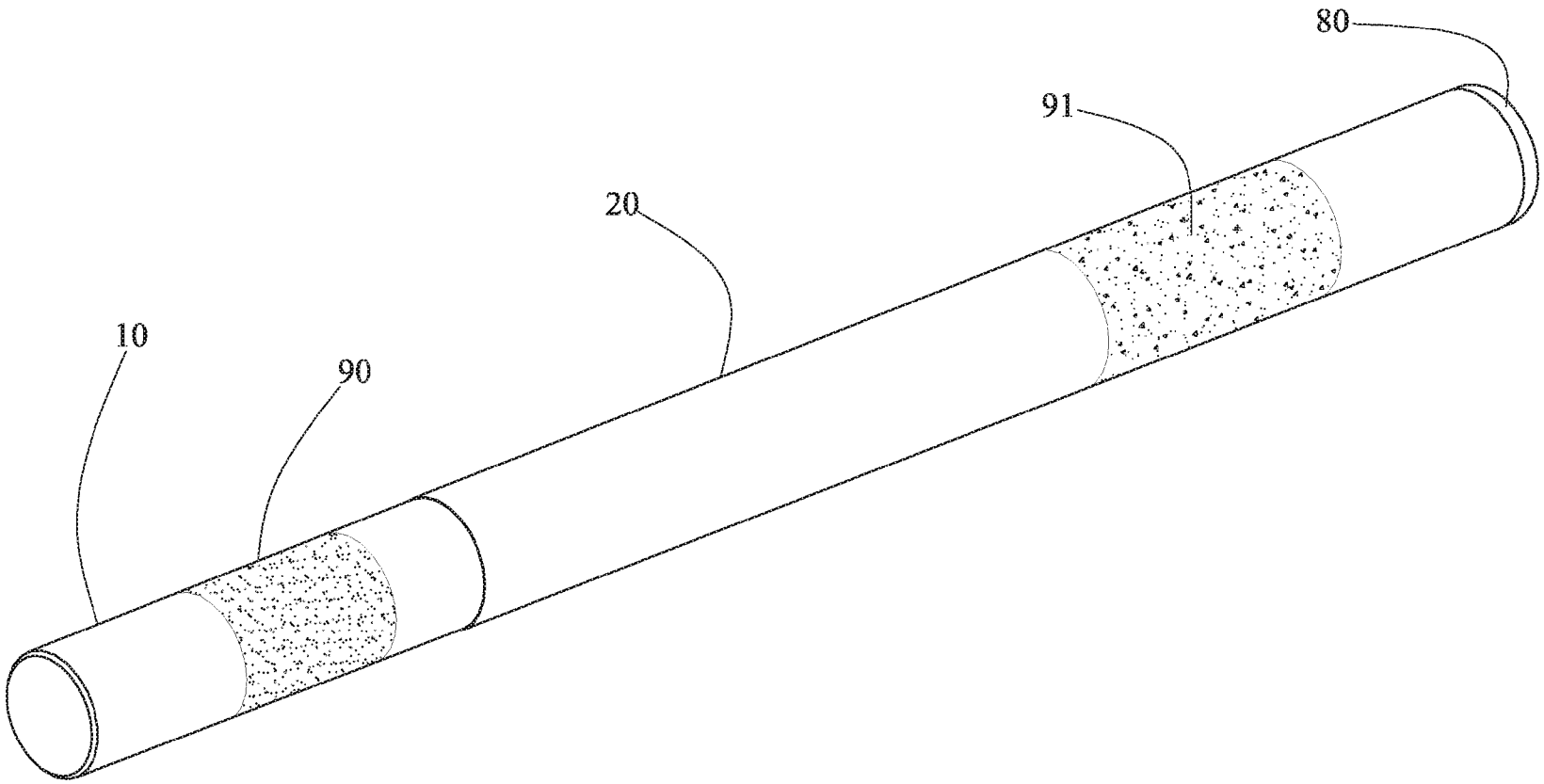
FIG. 6 is a perspective view of an eye liner pencil according to a second preferred embodiment of the invention.

Referring to FIG. 6, an eye liner pencil in accordance with a second preferred embodiment of the invention is shown. The characteristics of the second preferred embodiment are substantially the same as that of the first preferred embodiment except the following:

A ring shaped electroplating layer 90 is coated on the cap 10. A ring-shaped coating 91 is formed on the handle 20. The layer 90 and the coating 91 are provided for facilitating the gripping of the cap 10 and the handle 20 respectively and being aesthetic.

It is envisaged by the invention that in addition to the advantages discussed in the above paragraph, the following advantages are obtained: The integrally formed felt wick 40 and the applicator 41 eliminates the drawback of assembling the brush and the felt wick of the conventional eye liner pencil, thereby decreasing the number of components and the manufacturing cost. The mouth of the opening 51 is shaped to allow the applicator 41 to pass through and be stopped when the applicator 41 contacts the mouth of the opening 51. The slits 52 allow vapor in the handle 20 to escape so as to balance internal pressure of the handle 20 and the atmospheric pressure, thereby facilitating liquid to flow through the felt wick 40 in the eye liner color applying operation. Finally, the sponge member 60 pressed between the felt wick 40 and the handle 20 and proximate the opening 71 can absorb liquid overflowed from the reservoir 70.

While the invention has been described in terms of preferred embodiments, those skilled in the art will recognize that the invention can be practiced with modifications within the spirit and scope of the appended claims.

What is claimed is:

1. An eye liner pencil comprising:

a hollow, cylindrical cap including a rear opening and an internal annular ridge adjacent to the rear opening;

a stepped-diameter hollow member disposed in the cap and including an external annular projection releasably fastened in the cap;

a hollow, tubular handle including a first opening at a front end, an annular protrusion of decreased diameter disposed rearward of the first opening and configured to secure to the ridge, a second opening at a rear end, and an internal annular trough adjacent to the second opening;

a hollow, elongated support including a tapered rear end, a front opening, an internal space, an externally threaded section proximate the front opening, an annular inclined surface disposed between the front opening and the externally threaded section, and a plurality of equally spaced protuberances disposed rearward of the externally threaded section and secured to an internal surface of the protrusion;

a felt wick having a rear end engaged a bottom of the internal space, the felt wick including an applicator at a front tip;

a sleeve including a front opening and a plurality of parallel slits on a surface wherein both the felt wick and the sleeve are inserted through the second opening with the slits fastened by an internal surface of a front portion of the handle, and the applicator is exposed;

a cylindrical sponge member including an axial channel wherein the rear end of the support is inserted through the channel to secure the sponge member onto the support;

a cylindrical reservoir having an outer diameter less than an inner diameter of the handle and including a front opening for allowing the rear end of the support to insert into and to be fastened therein wherein the internal space is partially disposed in the front opening of the reservoir; and a hollow plug member including an external rim adjacent to a rear enlarged end wherein the trough is complimentarily engaged with the rim to secure the plug member and the handle together.

2. The eye liner pencil of claim 1, wherein a section between the first opening and the trough is tapered toward the first opening.

3. The eye liner pencil of claim 1, wherein the support further comprises an internally threaded section on a rear portion, the internally threaded section being threadedly secured to the externally threaded section.

4. The eye liner pencil of claim 1, wherein the front opening of the sleeve has a circular, oval, or polygonal mouth.

5. The eye liner pencil of claim 1, wherein the applicator is an integral part of the felt wick, and wherein the applicator is made of brush, tipped nylon, inclined nylon, or latex.

6. The eye liner pencil of claim 1, wherein the felt wick is inserted through the sleeve until being stopped and fastened with the applicator exposed at the front opening of the sleeve.

7. The eye liner pencil of claim 1, further comprising a ring shaped electroplating layer coated on the cap, and a ring-shaped coating formed on the handle.

8. The eye liner pencil of claim 1, wherein the cap, the hollow member, the support, the sleeve, and the plug member are made of an environment-friendly plastic.

9. The eye liner pencil of claim 1, wherein the slits are elongated and disposed rearward of the front opening.

* * * * *